United States Patent [19]

Perrin

[11] Patent Number: 4,892,206

[45] Date of Patent: Jan. 9, 1990

[54] REFILL BOTTLE

[75] Inventor: Alain Perrin, Rueil Malmaison, France

[73] Assignee: Cartier International B.V., Amsterdam, Netherlands

[21] Appl. No.: 143,484

[22] Filed: Jan. 13, 1988

[30] Foreign Application Priority Data

Jan. 16, 1987 [FR] France ..... 87 00468

[51] Int. Cl.[4] ..... B65D 8/04; B65D 8/08/23/08; A45D 34/00

[52] U.S. Cl. ..... 215/12.1; 220/448; 220/469

[58] Field of Search ..... 215/12.1, 12.2, 13.1; 40/310; D9/369, 455; D7/70; 220/448, 468, 469

[56] References Cited

U.S. PATENT DOCUMENTS

| | | | |
|---|---|---|---|
| 535,550 | 3/1895 | Muller | 215/12.1 |
| 1,468,808 | 9/1923 | Hamilton | 215/12.1 |
| 1,698,510 | 1/1929 | Reutter | 215/12.1 |
| 1,719,488 | 7/1929 | Rokeach | 215/12.1 |
| 1,843,325 | 2/1932 | Kappelly | 215/12.1 |
| 2,328,338 | 8/1943 | Hauptman | 215/12.1 |
| 2,376,064 | 5/1945 | Knapp | 215/13.1 |
| 2,859,891 | 11/1958 | Carkin | 215/12.1 X |
| 3,061,129 | 10/1962 | Fitzgerald | 215/12.1 X |
| 4,371,087 | 2/1983 | Saujet | 215/12.1 |

FOREIGN PATENT DOCUMENTS

| | | | |
|---|---|---|---|
| 76899 | 10/1893 | Fed. Rep. of Germany . | |
| 671628 | 2/1939 | Fed. Rep. of Germany | 215/12.1 |
| 1911613 | 9/1970 | Fed. Rep. of Germany | 40/310 |
| 8516785 | 11/1985 | Fed. Rep. of Germany . | |
| 689486 | 9/1930 | France | 215/12.1 |
| 736320 | 11/1932 | France | 215/12.1 |
| 1287487 | 2/1962 | France | 215/12.1 |
| 2402592 | 4/1979 | France . | |
| 2496601 | 6/1982 | France . | |
| 2525453 | 10/1983 | France . | |
| 2537093 | 6/1984 | France . | |
| 574714 | 3/1958 | Italy | 215/12.1 |
| 1313 | of 1864 | United Kingdom | 215/12.1 |
| 1670 | of 1883 | United Kingdom | 215/12.1 |

OTHER PUBLICATIONS

French Search Report–9/87 filed for French Application 8700468.

*Primary Examiner*—Sue A. Weaver

*Attorney, Agent, or Firm*—Cushman, Darby & Cushman

[57] ABSTRACT

The invention relates to a refill bottle where a refill is held by two half-shells connected along a substantially medial plane; a stand is securely joined with a lower portion of the first half-shell and the second half-shell includes a boss which securely joins it with the stand or the first half-shell while allowing it to see-saw about the refill bottle in order to close against the first half-shell. A threaded bushing is provided to mate with a one-half male thread portion of a neck to enable the two half-shells to be securely joined in the vicinity of the neck of the refill bottle at the upper portion of the bottle.

4 Claims, 2 Drawing Sheets

REFILL BOTTLE

FIELD OF THE INVENTION

The present invention relates to a refill bottle that can be used especially for perfume products.

BACKGROUND OF THE INVENTION

It is known that a certain number of products are sold in bottles that must have a luxurious appearance and therefore have a high cost price. As such packages are often small in capacity, either because of the high price of the product or because of the use made thereof, it has already been thought of to produce bottles which give the package its luxurious character and which hold a refill on their inside containing the product sold.

In this way, at the time of the initial sale, the user purchases the bottle containing the refill, and when the product contained in the refill has been used up, a second refill need merely be purchased; its price is not so high, because there is no need for it to have a luxurious appearance. The new refill need merely then be placed inside the bottle, in order to obtain the identical product to that initially sold.

Refill bottles also have the advantages of enabling storage of refills in less volume than that required for storing the complete bottles of this kind.

SUMMARY OF THE INVENTION

The present invention relates to a refill bottle that has the advantage of having a limited cost price and with which the esthetic appearance and luxurious character desired can easily be imparted to the bottle.

The subject of the present invention is a refill bottle, in which the refill is held by two half-shells connected along a substantially medial plane. A stand is securely joined with the lower portion of the first half-shell, and the second half-shell including a means which securely joins it with the stand or the first half-shell while allowing it to see-saw about the refill in order to close against the first half-shell. The refill bottle also includes means enabling the two half-shells to be securely joined in the vicinity of the neck of the refill, in the upper portion of the bottle.

In a first feature of the invention, the two half-shells are secured in the vicinity of the neck of the refill by an interlocking device, and a projecting part that is securely joined with one half-shell elastically engages, with force, a recess of complementary shape made in the other half-shell.

According to another preferred feature of the invention, the two half-shells are securely joined at the level of the neck of the refill by a female threaded bushing which simultaneously engages the outside of male threads provided partially on one half-shell and partially on the other half-shell, in order to assure the retention of these half-shells.

In a particular feature of the invention, the half-shell which supports the stand includes a recess, below the lower portion of the refill; this recess can be engaged by an extension located in the lower portion of the other half-shell.

In a particular feature of the invention, the refill includes in its lower portion an extension which engages a recess of complementary shape made in the stand in such a manner as to assure lateral positioning of the refill with respect to the two half-shells.

This positioning is useful because the methods of manufacturing the refills, which are made of glass, are such that considerable manufacturing tolerances must be accepted, which means that there are equally large amounts of play between the half-shells and the refill.

The extension, which is disposed in the lower portion of the refill, makes it possible to limit the consequence of these tolerances.

In accordance with a preferred feature of the invention, a slightly deformable compensation device is placed at least at certain points on the periphery of the refill, which makes it possible to adjust for the play of variable extent that may exist between the half-shells and the refill.

In a preferred feature of the invention, the compensation device has two extensions, likewise of plastic material, on its lower portion, which engage an opening of complementary shape made in the stand in such a manner as to correctly position the lower portion of the refill.

In accordance with a preferred feature of the invention, the half-shells hold the refill by pressing against it with their peripheries, not by their bottoms, which makes it possible to accommodate major tolerances in the thickness of the refill. Moreover, this characteristic makes it possible to open the bottoms of the half-shells in order to allow the refill to show, and to allow the product contained in the refill to show. Finally, it will be understood that the half-shells and the stand can be decorated and provided with accessories, such as handles, to lend the package its esthetic and luxurious character.

Similarly, a cap or lid which enhances the esthetic character of the half-shells and of the stand can be fixed on the neck of the refill or on the threaded ring that holds the upper portion of the two half-shells.

In accordance with the invention, the two half-shells are substantially connected along the middle of the thickness of the bottle, but it is not absolutely necessary that the two half-shells be identical; for example, one of them may have a lesser thickness over the majority of its cross section.

For the sake of better understanding of the invention, exemplary embodiments shown in the accompanying drawings will now be described, solely by way of illustration and without in any way limiting the scope of the invention.

DESCRIPTION OF THE PREFERRED EMBODIMENTS

Figure 1:
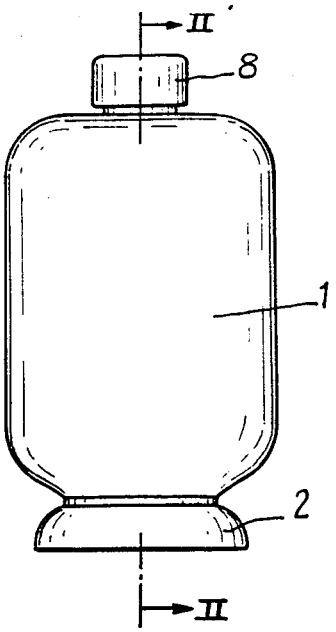
FIG. 1 is a front view of a first exemplary embodiment of the invention.

FIGS. 1–4 relate to a first exemplary embodiment of the invention and show the first half-shell 1, which is securely joined with the stand 2, as well as the second half-shell 3, which is provided in its lower portion with an extension 4 that engages a recess 5 of complementary shape made in the stand 2.

Figure 2:
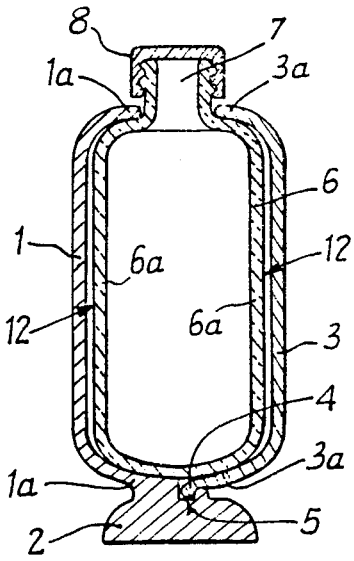
FIG. 2 is a sectional view taken along the line II-II of FIG. 1.
Figure 3:
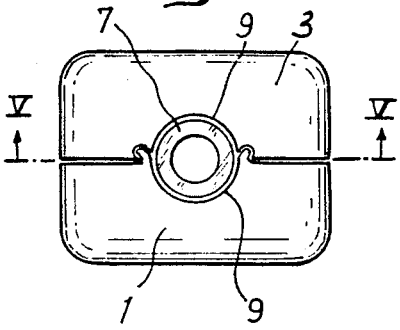
FIG. 3 is a plan view of FIG. 1.
Figure 5:
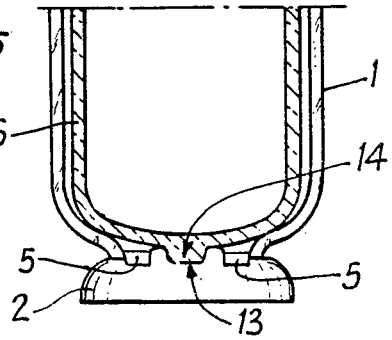
FIG. 5 is a fragmentary section taken along the line V—V of FIG. 3.

Also seen in FIGS. 2 and 5 is the refill 6, which comprises a receptacle made of glass, which in the present case has a substantially parallelepiped shape, and which is provided with a neck 7 in its upper portion, the neck having a thread engaged by a threaded plug 8. As seen in FIG. 3, the half-shells 1 and 3 each include a semicircular recess 9 in their upper portion to allow passage of the neck 7 of the bottle.

Figure 4:
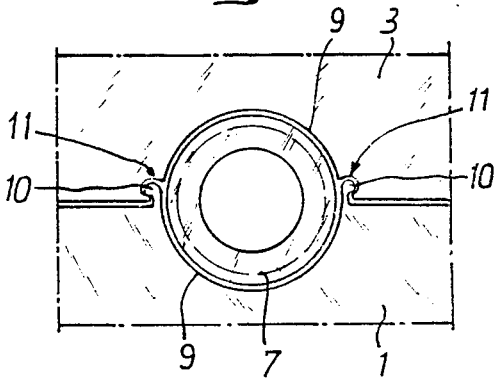
FIG. 4 is a view of the middle portion of FIG. 3, on a larger scale.

In the embodiment shown in FIGS. 3 and 4, the half-shell 1 includes two dog points 10 in the vicinity of the semicircular recess 9, which are capable of elastic engagement with the openings 11 of complementary shape made in the upper portion of the half-shell 3.

The dimensions of the dog points and of the recesses 11 as well as the characteristics of the material comprising the half-shells are such that when the dog points 10 engage the recess 11, the two shells are held together in the vicinity of the neck 7.

This interlocking is such that by exerting traction the dog points 10 can be disengaged from the recesses 11 and the two half-shells can be separated, so that the refill becomes accessible.

In accordance with a preferred characteristic of the invention, the refill 6 is held in the half-shells by their edges 1*a* and 3*a*, which press against the periphery of the refill, with a space 12 allowing for some play remaining between the lateral walls 6a of the refill and the bottoms of the half-shells 1 and 3.

Because of this kind of embodiment, correct holding of the refill inside the half-shells is assured, despite the dimensional tolerances that are inherent in the manufacture of the glass refill.

This characteristic also has the advantage that it is possible to make openings in the bottoms of the half-shells so as to allow the refill and its contents to be seen, without these openings in any way impeding the fixation of the half-shells and the holding of the refill without any significant movement when inserted.

In the embodiment shown in FIG. 5, the half-shell 3 is made firm n its lower portion by two extensions 4 that engage two recesses 5 in the stand 2, on either side of a recess 13 made in the stand, for receiving a boss 14 made in the lower portion of the refill 6.

This boss 14 has the advantage, by engaging the recess 13 of the stand, of correctly positioning the refill 6 inside the two half-shells.

To assemble the refill in the half-shells, it is sufficient, after having separated them, to place the refill 6 inside the half-shell 1 by making the boss 14 engage the recess 13, after which the extension 4 of the half-shell 3 is made to engage the recess 5 in the stand, and the half-shell 3 is pressed down against the refill in order to effect the interlocking of the dog points 10 with the recesses 11.

In FIGS. 6–10, which show another exemplary embodiment of the invention, the half-shell 1' is shown, which is securely joined with the stand 2' and which holds the refill 6' with the aid of the second half-shell 3', which is provided in its lower portion with an extension 4' that engages the recess 5' of the stand.

The bottom of each half-shell is provided with a circular opening which allows the refill and its contents to be viewed.

Figure 7:
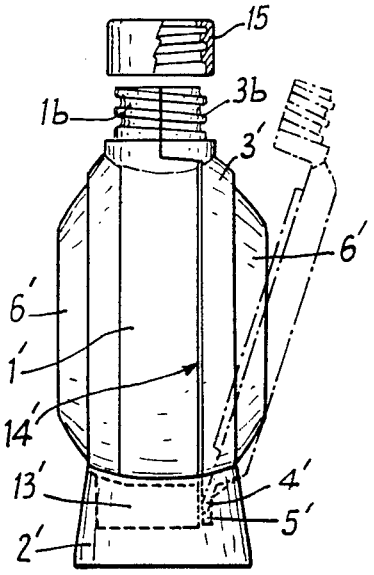
FIG. 7 is a view from the left o FIG. 6, in which the ring joining the two upper portions of the two half-shells is unscrewed and is shown partially removed.
Figure 8:
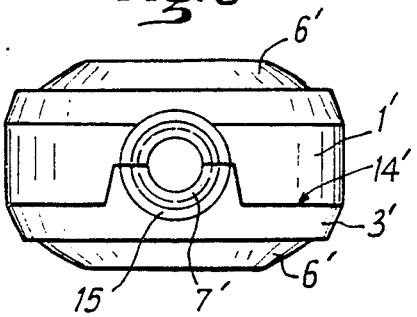
FIG. 8 is a plan view of FIG. 6.

In this exemplary embodiment, as seen in FIGS. 7 and 8, the half-shell 1' has a thickness greater than the half-shell 3', such that these two half-shells are not connected entirely in the medial plane of the bottle, but rather along the line 14' that corresponds to a purely esthetic ridge located symmetrically on the half-shell 1'.

The half-shell 1' is extended in its upper portion with a one-half male thread .1*b*, and the half-shell 3' is extended in its upper portion with a corresponding one-half male thread 3*b*.

Figure 6:
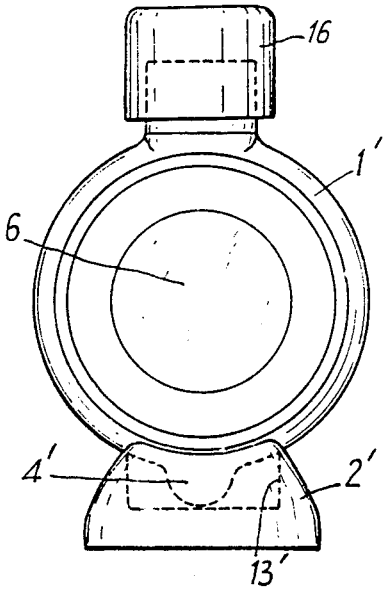
FIG. 6 is a front view of a second exemplary embodiment of the invention.

The secure joining of the two half-shells is effected with the aid of a threaded bushing 15 which engages the external thread comprising the two one-half threads 1*b* and 3*b*. The outer surface of the bushing 15 receives the lid 16, which is shown in FIG. 6 and which may have any arbitrary external shape.

In this embodiment, the refill 6' includes its own plug in its upper portion, or an atomizing device as well, which have not been shown in the drawing.

Figure 9:
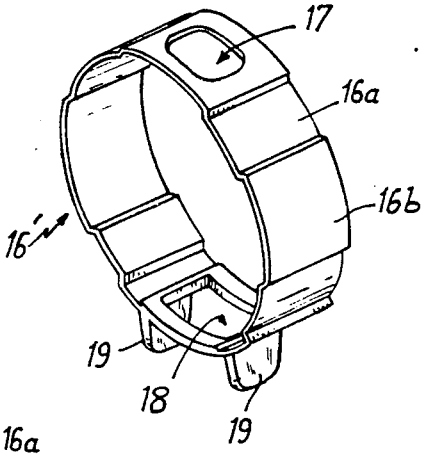
FIG. 9 is a perspective view of the compensator.

In FIG. 9, a compensator according to a preferred embodiment of the invention is shown, which makes it possible to fill up the variable space for play existing between the periphery of the half-shells 1' and 3' and the periphery of the refill 6 as a function of manufacturing tolerances.

This compensator 16' has a generally cylindrical form. In its upper portion it includes an opening 17 assuring the passage through it of the neck 7 of the refill. In its lower portion, it also includes a second opening 18, which is engaged by a boss of complementary shape made in the lower portion of the refill 6' in such a manner as to position the compensator 16 correctly on the periphery of the refill.

Finally, the compensator 16' includes two fins 19 in its lower portion which are intended to be braced against the walls of the recess 13' made in the stand 2' in order to assure the correct positioning of the lower portion of the refill with respect to the half-shell 1'.

Figure 10:
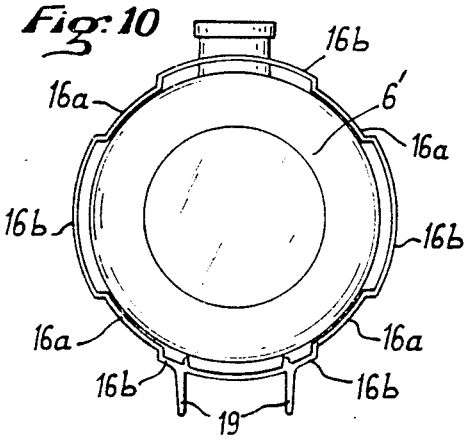
FIG. 10 is a front view of the refill provided with the compensator of FIG. 9.

Finally, as is clearly shown in FIG. 10, the compensator has the general shape of a Greek key on its periphery, as seen in profile; the portions 16*a*, of the compensator are braced against the periphery of the refill 6', while the portions 16*b* are spaced apart slightly to allow elastic engagement against the inside walls located on the periphery of the half-shells 1' and 3'.

it will be understood that in accordance with this preferred exemplary embodiment of the invention, the refill 6' is held by its periphery with the aid of the half-shells 1' and 3', while the compensator 16' assures not only the correct positioning of the refill with respect to the half-shell 1', because of small tongues 19 that engage the recess 13' of the stand and with respect to the opening 18 that receives a boss complementary shape located on the refill 6', but also an elastic compensation for the play of variable magnitude that necessarily exists between the periphery of the half-shells and the refill because of manufacturing tolerances.

Assembly of the bottle according to the invention is performed in a particularly simple and rapid manner.

First, the compensator 16' is placed around the refill 6', by first causing the neck 7 to engage the opening 17 and by introducing the corresponding boss into the lower recess 18.

After that, the tongues 19 are made to engage the recess 13' of the stand, thus inclining the refill, which is then pressed down on the inside of the half-shell 1'. Then the lower extension 4' of the half-shell 3' is made to engage the recess 5' of the stand, and the half-shell 3' is pressed down against the half-shell 1', so as finally to fix the two half-shells 1' and 3' together with the aid of the threaded bushing 15, which simultaneously engages the half-threads 1*b* and 3*b*.

A decorative lid may advantageously be placed detachably on the threaded bushing 15.

It is understood that the exemplary embodiments described above are given solely by way of example and do not limit the scope of the invention in any way.

What is claimed is:

1. Container for a refill bottle comprising two half-shells connectable along a substantially medial plane, the first one of said half-shells comprising a stand at its lower portion, the second one of said half-shells including releasable means for joining said second one of said half-shells with the lower portion of said first one of said half-shells, while allowing said second half-shell to be released to permit insertion of a refill bottle within said container and to close said second one of said half-shells against said first one of said half-shells, said shells including a neck receiving portion and having adjacent said neck receiving portions a releasable locking means for securely joining said two half-shells together, said container including compensation means comprising a slightly deformable bracelet of plastic material which is located at the periphery of the refill bottle between said half-shells and said refill bottle for compensating the clearance of variable extent that may exist between the half-shells and the refill bottle.

2. Container as claims in claim 1 in which said bracelet comprises surface portions for engaging the inside of the half-shells alternating with surface portions for engaging the outer surface of the refill bottle.

3. Container as claimed in claim 1 or 2, wherein said compensation bracelet includes an opening for receiving a boss located at the lower portion of said refill bottle.

4. Container as claimed in claim 1 in which said compensation bracelet includes projecting means and said stand includes an opening for receiving said projecting means for assuring a correct positioning of the refill bottle relatively to the container.

* * * * *